United States Patent [19]

Roche et al.

[11] 4,323,824

[45] Apr. 6, 1982

[54] LOW VOLTAGE FLUORESCENT OPERATING CIRCUIT

[75] Inventors: William J. Roche, Merrimac; Carlo S. Bessone, Woburn, both of Mass.

[73] Assignee: GTE Products Corporation, Stamford, Conn.

[21] Appl. No.: 106,171

[22] Filed: Dec. 21, 1979

[51] Int. Cl.[3] ..... H05B 37/00; H05B 39/00

[52] U.S. Cl. ..... 315/289; 315/DIG. 2; 315/101; 315/105

[58] Field of Search ..... 315/289, 276, 283, DIG. 2, 315/DIG. 5, DIG. 7, 105, 106, 101, 172, 174, 176, 306, 307

[56] References Cited

U.S. PATENT DOCUMENTS 3,466,500 9/1969 Peek ..... 315/289

3,701,925 10/1972 Nozawa et al. ..... 315/101

4,079,292 3/1978 Kaneda ..... 315/105

4,165,475 8/1979 Pegg et al. ..... 315/106

*Primary Examiner*—Harold A. Dixon

*Attorney, Agent, or Firm*—Edward J. Coleman

[57] ABSTRACT

A circuit for starting and operating a low-voltage fluorescent lamp from a 120 volt AC supply. The circuit includes a choke type ballast connected in series with the lamp and inductively coupled to a pulse train generator comprising an RC energy storage circuit connected across the line and a voltage sensitive transistorized relaxation oscillator having a divider network for sensing lamp voltage. In a preferred embodiment the circuit is employed in a preheat mode of operation in combination with an electronic starter circuit comprising a PTC resistor, silicon diode and SCR series connected across the lamp.

21 Claims, 4 Drawing Figures

LOW VOLTAGE FLUORESCENT OPERATING CIRCUIT

BACKGROUND OF THE INVENTION

This invention relates to circuits for operating fluorescent lamps and, more particularly, to an improved circuit for starting and operating a low-voltage fluorescent lamp from a source of AC line voltage.

With the growing need for saving energy in the home, the significantly greater efficiency of fluorescent lamps, in terms of lumens per watt, as compared to the more commonly used incandescent lamps has spurred engineering development of improved methods for placing fluorescent lamps into more wide-spread residential use. One approach toward accomplishing this end has been to search for improved retrofit systems for the existing incandescent lamp fixtures. More specifically, an object has been to provide an improved incandescent-to-fluorescent adapter having a simplified, lightweight and compact design of reduced cost. The retrofit system would have to permit starting and operation of a low-voltage fluorescent lamp from a conventional 120 volt, 60 cycle source of AC line voltage. With respect to independent safety testing laboratories, such as Underwriter's Laboratories (U.L.), however, concern with fluorescent retrofit systems involves socket voltage, along with the size and weight of the conversion unit. The socket voltage or voltage to ground in any portable lamp fixture is limited, for example, by U.L. standard No. 496 to an RMS voltage of 150 volts. This, in conjunction with a socket weight limitation of 2 ½ pounds, requires the lamp to be operated in a preheat mode using a glow-bottle starter in conjunction with a 120 volt choke or a 150 volt autotransformer ballast. Another safety concern is the possibility of being able to connect an unballasted fluorescent lamp directly across the 120 volt line. The possibility exists that the lamp will implode when operated without its intervening ballast. This means that with a conventional 120 volt preheat lamp/ballast system, the lamp must be contiguous with the ballast and mounted at the socket in the fixture. This would further aggrevate an already cramped socket airspace.

It would be possible to design the ballast as a plug-through unit located on the floor between the lamp fixture and the wall outlet. However, this would require the lamp to be fused to protect it from misuse, but such a fuse would have attendant disadvantages of cost, bulkiness, and possibly would require a unique size and shape so that the end user could not substitute a higher current fuse and thereby defeat the intended protection.

In addition to the aforementioned disadvantages, the conventional low-voltage preheat systems have exhibited comparatively slow and erratic starting.

SUMMARY OF THE INVENTION

Accordingly, it is an object of the present invention to provide an improved circuit for starting and operating a fluorescent lamp from a source of AC line voltage.

A particular object is to provide a circuit for obtaining more reliable starting of low-voltage fluorescent lamps from a conventional AC line voltage source.

A further object is to provide an improved electronic starter circuit for a preheat lamp operated from an improved circuit connected to a conventional AC line voltage source.

Yet another object is to provide a fluorescent lamp starting and operating circuit having improved safety features.

These and other objects, advantages and features are attained in a circuit having a series choke ballast inductively coupled to a voltage sensitive relaxation oscillator which is operative in combination with an energy storage means connected across the line to provide a pulse train during a half cycle of the line voltage. The energy storage means comprises a resistor and capacitor series connected across the line, and in applications where an instant start mode of operation is desired, the values of the resistor and capacitor are selected whereby the energy of the pulses coupled to the choke ballast is obtained primarily from the line voltage source through the resistor; in this arrangement, the energy of the capacitor serves primarily to supplement the line voltage at the initiation of each pulse. Upon normal operation of the lamp after ignition, the oscillator becomes dormant, whereby the choke ballast assumes full control of lamp operation.

Coupling of pulses to the choke ballast is provided by a coupling winding series connected between the RC energy storage circuit and the oscillator. This coupling winding and choke respectively comprise the primary and secondary of a step-up transformer. The source of AC line voltage has a first frequency, and the pulse train provided from the coupling winding has a second frequency which is substantially higher than the first frequency, preferably by greater than an order of magnitude. A transistorized oscillator circuit, particularly of a bilateral type, is preferred, and generation of a pulse train via the step-up transformer is operative to modulate the first frequency line voltage with a higher voltage pulse train at the second frequency.

In the preferred preheat mode of operation, the resistor of the RC energy storage circuit is selected to have a value sufficiently high to decouple the capacitor from the line source during oscillator switching, whereby the energy coupled to the choke is obtained from the capacitor. Of course, in such an arrangement, a preheat type lamp with filament coils is employed, and a starter is adapted to be connected across the lamp.

According to a preferred embodiment of the invention, the starter is an electronic circuit comprising a positive-temperature-coefficient (PTC) resistor connected in series with a voltage sensitive diode means having a selected forward breakdown voltage, such as about 400 volts. Preferably, the voltage sensitive diode means comprises a silicon controlled rectifier (SCR) connected in series with a diode having a peak inverse voltage of about 800 volts.

Size and weight reduction at the lamp socket can be achieved by physically separating the lamp from the ballast circuitry. This can be done by use of the circuitry in accordance with the present invention while still overcoming any objections, pertaining to lamp safety as previously dicussed. More specifically, the standard glowbottle starter cannot be used in this instance since it will respond to the 120 volt line voltage and cause the lamp to self destruct if used without a ballast. Accordingly the aforementioned electronic starter overcomes this problem by desensitizing the lamp to the 120 volt supply, and causing it instead to be actuated by a high voltage pulse signal generated in the above described oscillator ballast. The function of the diode in the electronic starter circuit is to prevent reverse breakdown of the SCR. The SCR itself has a forward breakdown rating of at least twice the line voltage and requires a high voltage pulse to initiate conduction. The SCR is, therefore, conductive on one half cycle of the AC supply and nonconductive on the next. During the conductive phase, rapid preheating of the lamp coils takes place due to the direct current component in the inductive choke. The rate of rise of this current is a quasilinear function of time and also varies inversely with the coke inductance. After each conducting half-cycle of the SCR, the lamp is made available for starting by a high voltage pulse train from the ballast circuitry which appears across the lamp on the ensuing half cycle. This combination of rapid coil preheating, alternating with the high voltage starting pulses assures a quasi-rapid starting mode in the lamp which is both aesthically superior to the conventional preheat starting mode, as well as more beneficial to lamp life. The function of the PTC element is two-fold. First, it protects the circuit under abnormal starting conditions, (i.e., failed lamp), by shutting the circuit down to prevent overheating of the coke. Second, it prevents a destructive coil flashover if the lamp were to be used without its ballast. Coil flashover can occur even if the SCR breakdown voltage exceeds the line voltage supply. This phenomenon is caused by the line voltage transients. These transients can trigger the SCR and cause the full 120 volt line supply to appear across the lamp coils through the starter. While this voltage is insufficient to cause the lamp to flash from end-to-end, it can cause the coils to flash. The PTC resistor in the starter functions as a voltage divider and limits the voltage drop at each coil to about 10 volts. With this type of starter, the lamp is self-protected and does not require a protective fuse.

As described hereinbefore, the ballast required to trigger the special starter is a hybrid design. During lamp operation it functions as a normal series choke type ballast. During the lamp starting phase it functions as a symmetric pulse train generator which modulates the 120 volt line, for example, with a 1,200 volt, low energy, 2.4 KHz pulse train. This pulse train provides the source for starter activation and lamp breakdown voltage. The RMS open circuit voltage of this waveform is about 135 volts, well within the 150 volt U.L. limit.

In a preferred embodiment, the transistorized oscillator circuit comprises a pair of switching transistors (NPN and PNP) connected for bilateral operation. Each of the transistors have respective base, emitter and collector electrodes, and the oscillator further includes means connecting the transistors via the collector-emitter electrodes thereof between the coupling winding and a common conductor. The base electrodes of the transistors are connected to a common junction. A voltage divider comprising first and second resistors connected between the output terminals of the circuit, and a first capacitor is connected across the second resistor. A breakdown diode means is coupled between the junction of the base electrodes of the transistors and the junction of the divider resistors and the first capacitor. The frequency of the oscillator and the resulting pulse trains are determined by the selected values of the first and second resistors and the first capacitor. The oscillator circuit further includes a third resistor series connected between the breakdown diode means and the junction of the base electrodes, and the pulse duration of the oscillator is determined by the selected values of the third resistor and first capacitor. In a preheat type circuit, therefore, the ballast circuit of the present invention, which causes a high voltage pulse train to be generated during half cycles of the line voltage, assures reliable starting of the lamp, in addition to the safety features mentioned hereinbefore when employed in combination with the electronic starter circuit.

Where applications permit, the oscillator-ballast circuitry of the invention is also useful for permitting operation of a low voltage fluorescent lamp directly from a 120 volt supply without resorting to preheating of the lamp electrodes. Although higher voltage circuits are available which will start the lamp without cathode preheating, these circuits involve voltage transformation means which are costly and which are not suitable for portable lighting applications due to the safety factor inherent in their high voltage design. The present invention can provide for cold cathode starting of a low voltage fluorescent lamp (for example, 10–70 volts) on a 120 volt circuit by means of the described voltage pulsing circuit. The concept of pulse starting is not unique to the present invention. Single pulse-start circuits, both conventional (glow-bottle) and solid state designs, have been described in the prior art. These circuit designs, however, require means for preheating the lamp coils in order to function, and therefore, do not fit into the category of the instant start embodiment of the present invention. A copending application Ser. No. 808,126, filed June 20, 1977, and assigned to the present assignee describes a cold cathode pulse-start circuit for an HID lamp. The HID pulse-start circuit, however, was found to be unsuitable for fluorescent lamp applications since both the pulse energy and pulse frequency are inadequate to start a fluorescent lamp. In order to obtain the required pulse parameters suitable for fluorescent application, a basic change in circuitry was required. Further, in addition to inadequate energy per pulse, the starting phase of the HID pulse start circuit of the aforementioned copending application, generated only a single pulse per half cycle. This is also true of a pulse start circuit described in U.S. Pat. No. 3,466,500 Peek. The generation of a high energy series of pulses during each half cycle, as provided by the present invention, substantially increases the speed and reliability of the starting cycle.

BRIEF DESCRIPTION OF THE DRAWINGS

This invention will be more fully described hereinafter in conjunction with the accompanying drawings, in which.

DESCRIPTION OF PREFERRED EMBODIMENT

Figure 1:
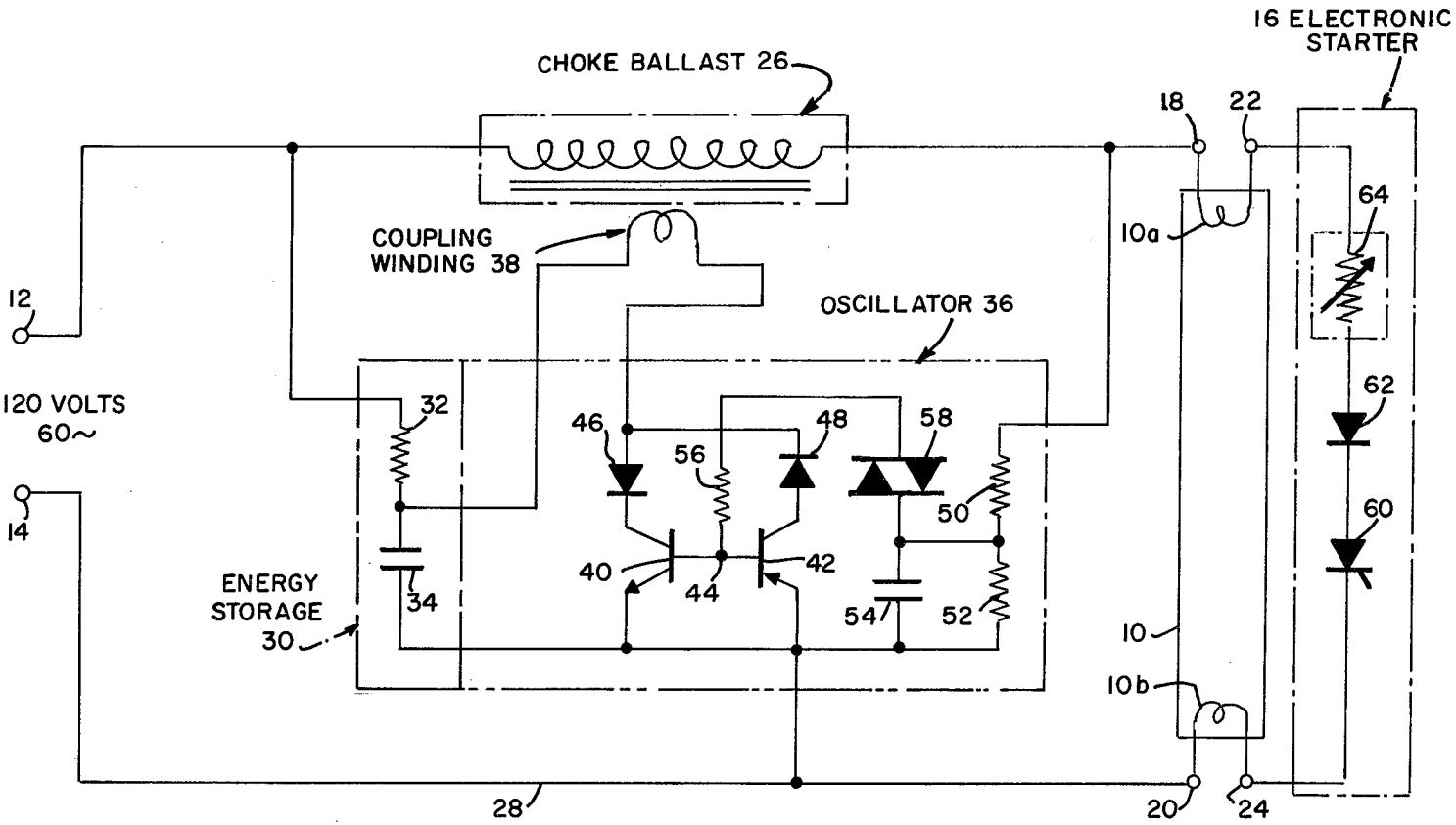
FIG. 1 is a schematic diagram of a fluorescent lamp starting and operating circuit in accordance with the invention, in combination with an electronic starting for preheat operation.

Referring to FIG. 1, the starting and operating circuit according to the invention is illustrated as used with a low voltage, preheat type fluorescent lamp 10 operated from a voltage supply source represented by input terminals 12 and 14. In the typical application, voltage supply 12, 14 is a 120 volt, 60 cycle line source. Also illustrated is an electronic starter circuit 16 in accordance with the invention. Lamp 10 has a pair of filament coils 10*a* and 10*b* which are connected to the operating circuit output terminals 18 and 20, respectively. The opposite ends of the filament coils 10*a* and 10*b* are respectively connected to terminals 22 and 24 of the electronic starter circuit 16. It is to be understood, however, that the starting and operating circuit (shown to the left of the lamp 10) is not limited to use with preheat lamps but in certain applications may also be useful with instant start types. In the latter case, starter circuit 16 would be removed, and filament coil terminals 22 and 24 would be shorted respectively to terminals 18 and 20, whereby the lamp would be adapted for cold cathode starting.

The starting and operating circuit to the left of lamp 10 in FIG. 1 comprises a magnetic choke ballast 26 series connected between input terminal 12 and output terminal 18. A common conductor 28 is connected between the other input terminal 14 and the second output terminal 20. Connected across the line between input terminals 12 and 14 is an energy storage circuit 30 comprising the series connected combination of a resistor 32 and capacitor 34. Connected between the output terminal 18 and the common conductor 28 is voltage sensitive relaxation oscillator 36. Connected between the energy storage circuit 30 and oscillator 36 is a winding 38 for inductively coupling pulses to the choke ballast 26. More specifically, coupling winding 38 and choke ballast 26 comprise the primary and secondary, respectively, of a step-up transformer.

Oscillator 36 is preferably transistorized and of the bilateral switching type. In the embodiment illustrated, the oscillator includes NPN transistor 40 and a PNP transistor 42 having their base electrodes connected to a common junction 44. The emitters of both of the transistors are connected to the common conductor 28, and the collector electrodes of the transistors 40 and 42 are connected through diodes 46 and 48, respectively, to one end of the coupling winding 38. The other end of winding 38 is connected to the junction of resistor 32 and capacitor 34 of the energy storage circuit. Control of the bilateral transistor switching circuit is provided by a voltage divider, including resistors 50 and 52, a firing capacitor 54 connected across resistor 52, and a resistor 56 and a breakdown diode (illustrated as diac 58) series connected in that order between junction 44 of the transistor bases and the junction of the voltage divider resistors and capacitor 54. The divider resistors 50 and 52 are series connected between output terminal 18 and the common conductor 28.

In the case of the alternative mode of operation for achieving low-voltage instant start of fluorescent lamp 10 directly from the 120 volt line source, electronic starter 16 is deleted and the two ends of each of the filament coils 10*a* and 10*b* are shorted together, as mentioned hereinbefore. This, in essence, provides one lead at each end of the lamp for facilitating cold cathode starting of the lamp. For this application, the value of resistor 32 in the energy storage circuit is selected to have a very low value, e.g., 47 ohms. With such an arrangement, pulse energy is obtained primarily from the line supply voltage through resistor 32. The energy of capacitor 34 serves primarily to supplement the line voltage at the initiation of each pulse. Since the main pulse energy source is the AC supply voltage, which functions as a pseudo infinite capacitor over the time duration of the pulse, the resulting pulse energy can be extremely high. This energy source is connected to the primary (or coupling) winding 38 of the pulse transformer through the parallel transistor switch 40, 42. Transistor 40 performs this switching function for one polarity of the AC supply voltage, while transistor 42 performs a similar function when the polarity reverses.

The use of transistors as switches, instead of a triac, such as employed in the HID circuit of the aforementioned copending application Ser. No. 808,126, allows for a plurality of voltage pulses, since the transistor can be "re-set" after each pulse allowing the primary of the transformer to be reenergized repeatedly. This is not possible with the aforementioned HID triac circuit unless elaborate and costly means are used for triac commutation or unless means are used, such as a high value of resistor 32, for allowing the discharge current to fall below the triac holding current. This latter option is obtainable only for comparatively low pulse energy circuits.

The switching of the transistors is effected by the network comprised of resistors 50, 52 and 56, along with the firing capacitor 54 and diac 58. This network functions as a voltage sensitive trigger circuit which drives the bases of the switching transistors. Specifically, the network comprising resistor 50 in series with the parallel combination of resistor 52 and capacitor 54 has a charging time constant equal to, $$\tau = \frac{R_{52}R_{50}}{R_{52} + R_{50}} C_{54} \tag{1}$$

The rate at which capacitor 54 charges is governed by equation (1). The voltage obtainable by capacitor 54 is determined by the resistance network 50 and 52 which functions in the capacity of a voltage divider which senses the lamp voltage. The maximum voltage which can be developed across capacitor 54 can be expressed as, $$V_{54} = V_0 \frac{R_{52}}{R_{52} + R_{50}} \cong V_{58} \tag{2}$$

where $V_0$ is the instantaneous value of the voltage appearing across the lamp terminals 18, 20, which prior to ignition is the AC supply voltage. After lamp ignition, this voltage divider network feature serves to shut down the oscillator 36 preventing the lamp from being pulsed. Thereafter, during normal lamp operation, the oscillator is rendered inoperative, or dormant, and only the magnetic choke ballast 26 remains in the lamp operating circuit to provide a conventional current ballasting function.

When the voltage on capacitor 54 reaches the breakdown value of the diac 58, capacitor 54 will discharge through resistor 56 into the base of either transistor 40 or transistor 42, depending upon the voltage polarity of the AC supply and hence the voltage across capacitor 54. The discharge time constant is $R_{56}C_{54}$, which is adjusted such that it is much less than the charging time constant of capacitor 54 given by equation (1).

The transistor base current supplied by the discharge of capacitor 54 turns the appropriate transistor "on," causing momentary current to flow in the primary winding 38 of the pulse transformer circuit. After capacitor 54 has discharged, diac 58 and the appropriate transistor will shut off causing the cessation of pulse current. Capacitor 54 will then begin to recharge, repeating the cycle. The result is a succession, or train, of voltage pulses appearing at the secondary (choke ballast 26) of the pulse transformer enabling the lamp to start quickly and reliably. With the bilateral operation, symmetric pulse trains are generated during successive half cycles of the line voltage.

The maximum pulse train energy delivered in this mode of operation over the duration of one half cycle of the 60 cycle voltage will equal:

$$E_t \cong \frac{L}{2}\left(\frac{\overline{V}_0^2}{R_{32}}\right)\Delta t_0 f \tag{3}$$

where $\Delta t_0$ is the time duration of the pulse train (e.g., about 4 msecs.), f is the pulse frequency, L is the inductance of winding 38, and $V_0$ is the average value of the line voltage $\Delta t_0$ (e.g., about 150 volts).

In this expression, there is no limitation on the minimum value for resistor 32. Hence, resistor 32 can be made as low as, say, 47 ohms, thereby greatly increasing the pulse train energy. The frequency of the oscillator and hence the resulting pulse train applied via coupling winding 38 to the choke 26 is determined by the value selected for the divider resistors 50 and 52 and capacitor 54. The pulse duration is determined by the values selected for resistor 56 and capacitor 54. The diodes 46 and 48 function as blocking diodes and serve to prevent transistor switching from occurring via the energy storage capacitor 34.

In one specific implementation of the present invention for the instant start mode of operation, the following component values were employed in the circuit of FIG. 1 for operating a 6½ inch 19WT9 Circline type lamp from a 120 volt, 60 cycle line source.

| | |
|---|---|
| Resistor 32 | 47 ohms, 1 watt |
| Resistors 50 and 52 | 47K ohms, ½ watt |
| Resistor 56 | 100 ohms, ¼ watt |
| Capacitor 34 | 2 microfarads, 200 volts |
| Capacitor 54 | 0.047 microfarads, 50 volts |
| Diac 58, forward breakdown | 28 volts |
| Diodes 46 and 48, reverse breakdown | 200 volts, 1 amp |
| Transistor 40 | 2N3584 |
| Transistor 42 | 2N6421 |
| Choke 26, $X_L$ | 275 ohms |
| $N_{26}$: $N_{38}$ | 7:1 turns ratio |

Although the above described instant start embodiment of the circuit may be suitable for a number of applications, it may be desirable, as discussed hereinbefore to modify the circuit for preheat operation so as to totally meet the U.L. concerns with respect to socket voltage and/or preventing the possibility of being able to connect an unballasted lamp directly across the 120 volt line. For such a preheat circuit application, referring again to FIG. 1, the starting and operating circuit to the left of lamp 10 remains the same, except for a change in certain of the component values, and an electronic starter 16 is connected across the lamp in accordance with the invention. The standard glow-botle starter would not be suitable in this instance since, if the lamp and ballast are separated, it will respond to the 120 volt line and cause the lamp to be destroyed if used without a ballast. We have designed an electronic starter which overcomes this problem by desensitizing the lamp to the 120 volt supply and causing it instead to be actuated by a high voltage pulse signal generated in the operating circuit to the left of the lamp in FIG. 1.

As illustrated, the starter 16 is a three component circuit consisting of a silicon controlled rectifier (SCR) 60, a silicon diode 62 and a positive-temperature-coefficient (PTC) resistor 64 series connected as illustrated across lamp terminals 24 and 22.

The function of diode 62 is to prevent reverse breakdown of the SCR 60. The SCR itself has a forward breakdown rating of at least twice the line voltage and requires a high voltage pulse to initiate conduction. The SCR is, therefore, conductive on one half cycle of operation and non-conductive on the next. During the conductive phase, rapid preheating of the lamp coils takes place due to the direct current component in the inductive choke 26. This current rise is a quasi-linear function of time and also varies inversely with the choke inductance. On each non-conducting half cycle of the SCR, the lamp is available for starting by a high voltage pulse train from the ballast circuit including oscillator 36, coupling winding 38 and the choke ballast 26, the energy for each pulse being provided by storage circuit 30. This combination of rapid coil preheating, alternating with high voltage starting pulses, assures a quasi-rapid starting mode in the lamp which is both aesthetically superior to the conventional preheat starting mode as well as more beneficial to lamp life.

The function of the PTC element 64 is two-fold. First, it protects the circuit under abnormal starting conditions, (i.e., failed lamp) by shutting the circuit down to prevent overheating of the choke. Second it prevents a destructive coil flashover if the lamp were to be used without its ballast. Coil flashover can occur even if the SCR breakdown voltage exceeds the line voltage supply. This phenomenon is caused by line voltage transients. These transients can trigger the SCR and cause the full 120 volt line supply to appear across the lamp coils through the starter. Although this voltage is insufficient to cause the lamp to flash from end-to-end it can cause the coils to flash. The PTC resistor 64 in the starter functions as a voltage divider and limits the voltage drop at each coil to about 10 volts. With this type of starter, the lamp is self-protected and does not require a protective fuse.

The ballast circuitry required to trigger the special starter 16 is the circuit previously described including the oscillator 36 and energy storage 30. For this preheat mode of operation, however, the value of resistor 32 is selected to be substantially higher, for example, about 2.7 Kohms, so as to decouple capacitor 34 from the line voltage source during oscillator switching whereby the energy coupled to the choke is obtained from capacitor 34. That is, capacitor 34 determines the pulse energy provided at coupling winding 38.

In operation, therefore, lamp 10 is operated through an inductive impedance $X_L$ (choke ballast 26) connected to the source of 120 volt potential (12, 14). The impedance winding also functions as the secondary of a step-up pulse transformer having a primary-to-secondary turns ratio of 1:7, for example. The pulse energy for lamp starting is developed through the resistance-capacitor network $R_{32}C_{34}$ and the aforementioned bilateral transistor switch 40, 42.

As previously described for the oscillator circuit, when the voltage on capacitor 54 reaches the breakdown value of the diac 58, capacitor 54 will discharge through resistor 56 into the base of either transistor 40 or transistor 42, depending on the voltage polarity of the AC supply and hence the polarity of the voltage across capacitor 54. The transistor base current supplied by the discharge of capacitor 54 turns the appropriate transistor "on" causing momentary current to flow in the primary of the pulse transformer circuit. After capacitor 54 has discharged, diac 58 and the appropriate transistor will shut off causing the cessation of pulse current. Capacitor 54 will then begin to recharge repeating the cycle. The result is a succession of voltage pulses appearing across coupling winding 38 and inductively coupled to the choke ballast 26, with the bilateral aperture providing symmetric pulse trains during successive half cycles of the line voltage.

In this instance, with the higher value of resistor 32 tending to decouple capacitor 34 from the line during transistor switching, the pulse energy is limited by the stored energy of capacitor 34, which is given by $$E_{34} = C_{34}\frac{V_{34}^2}{2} \tag{4}$$

The total pulse energy delivered by a circuit of this type over the duration of one half cycle of the 60 cycle supply voltage will equal:

$$E_t = \sum_{i=1}^{n}\left(\frac{C_{34}\,V_{34}^2}{2}\right)_i \cong \frac{C_{34}\overline{V}_{34}^2}{2}\,\Delta t_0 f \tag{5}$$

where n equals the number of pulses generated. As previously described with respect to the oscillator circuit, the quantity, n, is determined by the frequency of oscillator 36, which in turn is determined by the values selected for divider resistors 50 and 52 and capacitor 54. Since the capacitor 34 is effectively decoupled from the line supply voltage by the high value of resistor 32, the individual pulse energy is determined by the value of capacitor 34 and the total pulse energy will vary linearly with pulse frequency. Hence, the maximum individual pulse energy is somewhat limited over that discussed previously with respect to the instant start mode of operation. Nevertheless, the total pulse energy is more than adequate for the improved mode of preheat operation herein described.

Figure 2:
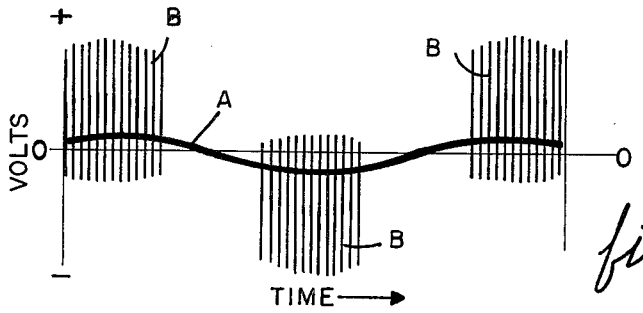
FIG. 2 is a waveform diagram showing the open circuit idling voltage vs. time for the operating circuit of FIG. 1.
Figure 3:
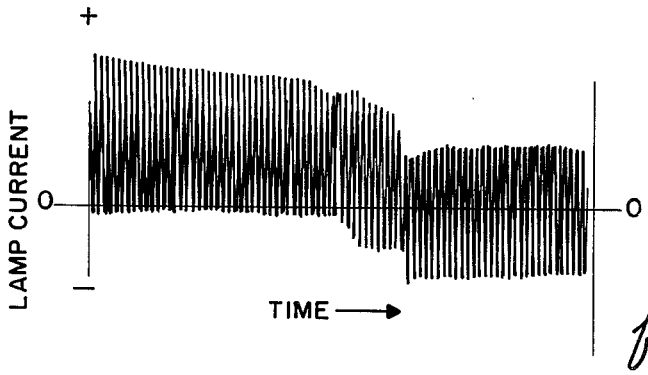
FIG. 3 is a waveform diagram showing lamp current vs. time for the normal lamp starting phase of the circuit of FIG. 1 in the preheat mode.
Figure 4:
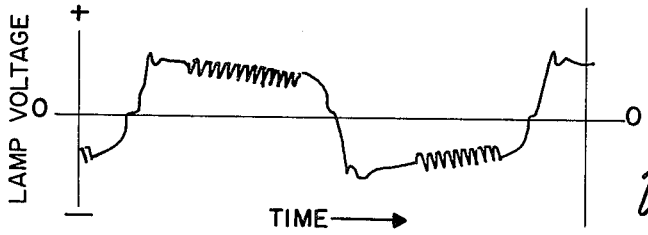
FIG. 4 is a waveform diagram showing the lamp operating voltage vs. time, (after ignition) for the circuit of FIG. 1.

During the lamp starting phase, therefore, the described preheat circuit functions as a symmetric pulse train generator which modulates the 120 volt line with a, for example, 1,200 volt, low energy 2.4 KHz pulse train. This pulse train provides the source for starter activation and lamp breakdown voltage. The RMS open circuit voltage of the waveform is about 135 volts, well within the 150 volt U.L. limit. For example, the waveform diagram of FIG. 2 shows the open circuit idling voltage across terminals 18 and 20, illustrating the 60 cycle line voltage A modulated with the symmetric pulse trains B on successive half cycles of the line voltage A. FIG. 3 shows the preheat lamp current during normal lamp starting using the circuit 16; the diminished current levels at the waveform transition indicate the period during which the lamp commences conduction. Once the lamp is ignited, the circuit functions as a normal choke type ballast, as illustrated by FIG. 4 which shows the lamp operating voltage.

In a specific embodiment of the preheat circuit of FIG. 1, the following component values were employed for operating a 6½ inch 19WT9 Circline fluorescent lamp from a 120 volt, 60 cycle line source. The system data was 930 lumens, 24 watts, 39 lumens per watt, and a projected lamp life of 10,000 hours based on current loading and starting mode.

| | |
|---|---|
| Resistor 32 | 2.7K ohms, 1 watt |
| Resistor 50 | 47K ohms, ½ watt |
| Resistor 52 | 22K ohms, ½ watt |
| Resistor 56 | 100 ohms, ¼ watt |
| Capacitor 34 | 0.02 microfarads, 200 volts |
| Capacitor 54 | 0.02 microfarads, 50 volts |
| Diac 58, forward breakdown | 28 volts |
| Diodes 46 and 48, reverse breakdown | 200 volts, 1 amp |
| Transistor 40 | 2N3584 |
| Transistor 42 | 2N6421 |
| Choke 26, $X_L$ | 275 ohms |
| $N_{26}$; $N_{38}$ | 7:1 turns ratio |
| Diode 62, peak reverse voltage | 800 volts |
| SCR 60, forward breakdown voltage | 400 volts |
| PTC resistor 64: | |
| zero power resistance at 25° C. | 20 ohms |
| voltage rating | 200 volts AC |
| switching (Curie) temperature | 60° C. |
| heat-up time to switching | 4 seconds |
| switched resistance | 20K ohms |
| switched dissipation | 0.3 watts |

Upon energizing this circuit, normal lamp starting averaged about 0.6 second.

Although the invention has been described with respect to specific embodiments, it will be appreciated that modifications and changes may be made by those skilled in the art without departing from the true spirit and scope of the invention. For example, the switching oscillator circuit 36 could be unidirectional, i.e., provide pulses on every other half cycle, but in the preheat embodiment, starter circuit 16 would have to be appropriately polarized. The combination of SCR 60 and diode 62 could be replaced by another suitable type of voltage sensitive diode means having a selected forward breakdown voltage, such as a single diac or a special SCR having a suitably high reverse breakdown voltage. The illustrated circuit, however, appears to be the more economical option.

We claim:

1. A circuit for starting and operating a fluorescent lamp from a source of AC line voltage comprising, in combination:

first and second input terminals for connection across said source of line voltage, and first and second output terminals for connection across said lamp;

a choke ballast series connected between said first input terminal and said first output terminal;

a common conductor connected between said second input terminal and said second output terminal;

energy storage means connected between said first and second input terminals;

a voltage sensitive relaxation oscillator connected between said first output terminal and said common conductor; and means connected between said energy storage means and said oscillator including a winding for inductively coupling pulses to said choke ballast, said oscillator being operative during the process of starting said lamp to repeatedly switch said storage means across said coupling winding to provide a pulse train therefrom during a half cycle of said line voltage.

2. The circuit of claim 1 wherein said energy storage means comprises a resistor and capacitor series connected in that order between said first and second input terminals, and said coupling winding is series connected between said oscillator and the junction of said resistor and capacitor.

3. The circuit of claim 2 wherein the values of said resistor and capacitor are selected whereby the energy of the pulses coupled to said choke is obtained primarily from said line voltage source through said resistor, with the energy of said capacitor serving primarily to supplement said line voltage at the initiation of each pulse, said circuit thereby being operative to ignite said lamp in an instant start mode, and upon normal operation of said lamp after ignition thereof, said oscillator becoming dormant, whereby said choke ballast assumes full control of lamp operation.

4. The circuit of claim 3 wherein said coupling winding and said choke ballast comprise the primary and secondary, respectively, of a step-up transformer, said source of AC line voltage has a first frequency, said pulse train has a second frequency higher than said first frequency by greater than an order of magnitude, said oscillator is transistorized, and generation of said pulse train via said step-up transformer is operative to modulate said first frequency line voltage with a higher voltage pulse train at said second frequency.

5. The circuit of claim 2 wherein the value of said resistor is sufficiently high to decouple said capacitor from said line source during oscillator switching whereby the energy coupled to said choke is obtained from and determined by said capacitor, and said fluorescent lamp is a preheat type, and further including a starter adapted to be connected across said lamp.

6. The circuit of claim 5 wherein said starter is an electronic circuit comprising a positive-temperature-coefficient (PTC) resistor connected in series with a voltage sensitive diode means having a selected forward breakdown voltage.

7. The circuit of claim 6 wherein said PTC resistor has a zero power resistance at 25° C. of about 20 ohms, a switching temperature of about 60° C., and a heat-up time to switching of about 4 seconds.

8. The circuit of claim 6 wherein the forward breakdown voltage of said diode means is at least about 400 volts.

9. The circuit of claim 8 wherein said diode means comprises a silicon controlled rectifier (SCR) having said forward breakdown voltage, and a diode having a peak reverse voltage of about 800 volts; said PTC resistor, diode, and SCR being series connected.

10. The circuit of claim 1 further including a starter adapted to be connected across said lamp, said starter comprising an electronic circuit including a positive-temperature-coefficient (PTC) resistor connected in series with a voltage sensitive diode means having a selected forward breakdown voltage.

11. The circuit of claim 1 wherein said coupling winding and said choke ballast comprise the primary and secondary, respectively, of a step-up transformer, said source of AC line voltage has a first frequency, said pulse train has a second frequency higher than said first frequency by greater than an order of magnitude, said oscillator is transistorized, and generation of said pulse train via said step-up transformer is operative to modulate said first frequency line voltage with a higher voltage pulse train at said second frequency.

12. The circuit of claim 1 wherein said oscillator comprises a pair of switching transistors connected for bilateral operation, whereby symmetric pulse trains are generated from said coupling winding during successive half cycles of said line voltage.

13. The circuit of claim 12 wherein said transistors each have respective base, emitter and collector electrodes; and said oscillator further includes: means connecting said transistors via the collector-emitter electrodes thereof between said coupling winding and said common conductor, means connecting the base electrodes of said transistors to a common junction, a voltage divider including first and second resistors series connected between said first output terminal and said common conductor, a first capacitor connected across said second resistor, and a breakdown diode means coupled between the junction of the base electrodes of said transistors and the junction of said divider resistors and first capacitor, the frequency of said oscillator and said pulse trains being determined by the selected values of said first and second resistors and said first capacitor.

14. The circuit of claim 13 wherein said oscillator further includes a third resistor connected between said breakdown diode means and said junction of the base electrodes of said transistors, the pulse duration of said oscillator and the duration of each of the pulses from said coupling winding being determined by the selected values of third resistor and said first capacitor.

15. The circuit of claim 14 wherein said energy storage means comprises a fourth resistor and a second capacitor series connected in that order between said first and second input terminals, and said coupling winding is series connected between said pair of transistors and the junction of said fourth resistor and second capacitor.

16. The circuit of claim 15 wherein said pair of transistors are NPN and PNP types, respectively, the emitter electrodes thereof are connected to said common conductor, and said oscillator further includes first and second blocking diodes each connected in series with a respective one of said collector electrodes for preventing transistor switching from occurring via said second capacitor, each of said collector electrodes being connected through a respective one of said first and second diodes to one end of said coupling winding, the other end of said coupling winding being connected to the junction of said fourth resistor and second capacitor.

17. The circuit of claim 15 wherein the value of said fourth resistor is sufficiently high to decouple said second capacitor from said line source during oscillator switching whereby the energy coupled to said choke is obtained from and determined by said second capacitor, and said fluorescent lamp is a preheat type, and further including a starter adapted to be connected across said lamp.

18. The circuit of claim 17 wherein said starter is an electronic circuit comprising a positive-temperature-coefficient (PTC) resistor connected in series with a voltage sensitive diode means having a selected forward breakdown voltage.

19. The circuit of claim 18 wherein said PTC resistor has a zero power resistance at 25° C. of about 20 ohms, a switching temperature of about 60° C., and a heat-up time to switching of about 4 seconds.

20. The circuit of claim 18 wherein the forward breakdown voltage of said voltage sensitive diode means is at least about 400 volts.

21. The circuit of claim 20 wherein said diode means comprises a silicon controlled rectifier (SCR) having said forward breakdown voltage, and a third diode having a peak reverse voltage of about 800 volts; said PTC resistor, third diode, and SCR being series connected.

* * * * *